United States Patent [19]

Yerman

[11] 4,192,429

[45] Mar. 11, 1980

[54] VENTED VACUUM TUBE AND STOPPER

[75] Inventor: Arthur J. Yerman, Manahawkin, N.J.

[73] Assignee: Becton, Dickinson and Company, Rutherford, N.J.

[21] Appl. No.: 19,007

[22] Filed: Mar. 9, 1979

Related U.S. Application Data

[63] Continuation of Ser. No. 882,807, Mar. 2, 1978, abandoned.

[51] Int. Cl.[2] ..... B65D 51/16

[52] U.S. Cl. ..... 215/307; 215/31

[58] Field of Search ..... 215/31, 307, 1 R; 220/366, 360; 53/405, 432

[56] References Cited

U.S. PATENT DOCUMENTS

| | | | |
|---|---|---|---|
| 759,889 | 5/1904 | Howells | 215/31 |
| 1,819,279 | 8/1931 | Coyle | 220/366 |
| 2,649,245 | 8/1953 | Silverstolpe | 215/364 X |
| 2,813,651 | 11/1957 | Schlumbohm | 215/307 X |

FOREIGN PATENT DOCUMENTS

| | | | |
|---|---|---|---|
| 1486483 | 5/1967 | France | 215/307 |
| 780853 | 8/1957 | United Kingdom | 215/31 |

*Primary Examiner*—Donald F. Norton

*Attorney, Agent, or Firm*—Kane, Dalsimer, Kane, Sullivan and Kurucz

[57] ABSTRACT

The disclosure is of an improved vacuum tube having one or more vents around the mouth to allow evacuation, prior to closure assembly, which tube eliminates the necessity of using a vented stopper and avoids the problems inherent in such vented stopper.

1 Claim, 8 Drawing Figures

VENTED VACUUM TUBE AND STOPPER

This is a continuation of application Ser. No. 882,807, filed Mar. 2, 1978 and now abandoned.

BACKGROUND OF THE INVENTION

1. Field of the Invention

The invention relates to stoppered vacuum tubes and more particularly to a tube provided with one or more vents around the mouth to allow evacuation.

2. Brief Description of the Prior Art

It has been desirable from the standpoint of assembly and economics to place a vent in the stopper for vacuum tubes to allow evacuation of the tubes. Such vented stopper is pre-positioned in a glass tube, allowing only a required length of slot exposed to the atmosphere which is necessary for removal of air in the tube. Upon removal of air, the stopper is driven up to its shoulder and seals the tube from the atmosphere. Some of the problems inherent in such design are as follows:

(a) The construction of the stopper is subject to cell entrapment or attachment to the slot;

(b) The stopper seal is vulnerable to lateral load which can occur in handling or processing, and result in a zero draw tube; and (c) Reliability in pre-placement depth control is required to prevent positive pressure tubes.

The prior art revealed the following U.S. Patents: Mond No. 1,399,394 which discloses a graduated glass tube having a pour spout at one end and a stopper inserted in the opposite flared end, and Silverstolpe No. 2,649,245 which allows a tubular vessel stoppered at both ends and in several embodiments shows slots in the outer stopper wall or passageways through the central portion of the stopper. Neither patent has any suggestion of a vent passageway on the tube structure.

SUMMARY OF THE INVENTION

The invention comprises a vacuum tube having a mouth adapted to receive a stopper which mouth is provided with one or more grooves, channels, indentations, slots or similar geometric forms each to serve as a vent to allow evacuation of air from between the mouth and the stopper.

DETAILED DESCRIPTION OF THE PREFERRED EMBODIMENTS OF THE INVENTION

The primary purpose of a vent (either in a stopper or a tube) is to allow pre-placement of the assembly prior to evacuation rather than during or within a vacuum which is a process problem.

Figure 1:
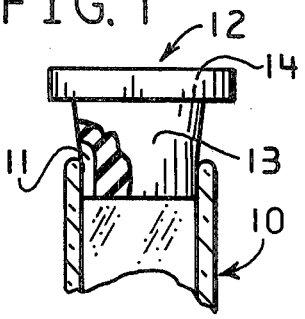
FIG. 1 is a sectional view of the open end of a conventional vacuum tube with a vented stopper pre-positioned in the mouth of the tube.
Figure 2:
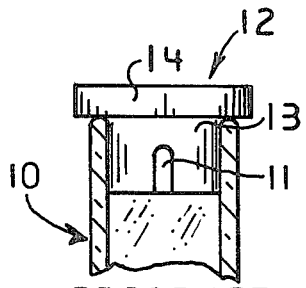
PRIOR ART FIG. 2
FIG. 2 is a view similar to FIG. 1 showing the vented stopper seated up to its shoulder in the tube.
Figure 3:
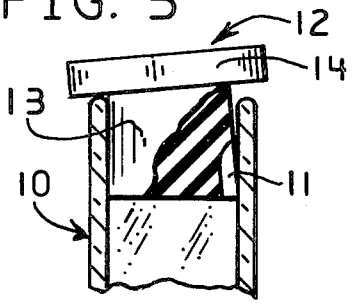
PRIOR ART FIG. 3
FIG. 3 is a view similar to FIG. 2 showing the vented stopper when there is a lateral load causing a reduction or loss of stopper seal.

FIGS. 1–3 show the open end of the vacuum tube presently in use. Such tube 10 does not have a vent or vents and accordingly requires a vent 11 molded in the stopper 12 to allow evacuation and assembly with the present processing equipment. The stopper has a plug portion 13, which has one or more of the vents 11, and a cap portion or flange 14. This stopper 12 is pre-positioned in the glass tube 10 (FIG. 1) allowing only a required length of slot or vent 11 exposed to the atmosphere to permit removal of air in the tube. Upon removal of air, the stopper is driven into the tube so that the cap 14 rests against the edge of the tube and the plug 13 seals the tube from the atmosphere (FIG. 2).

The disadvantages inherent in such present design are (a) Cell entrapment or attachment to slot in stopper.

(b) Vulnerability of stopper seal to lateral load which can occur in handling or processing and a possible zero tube draw (FIG. 3); and (c) Reliability in pre-placement depth control required to prevent positive pressure tubes.

Figure 4:
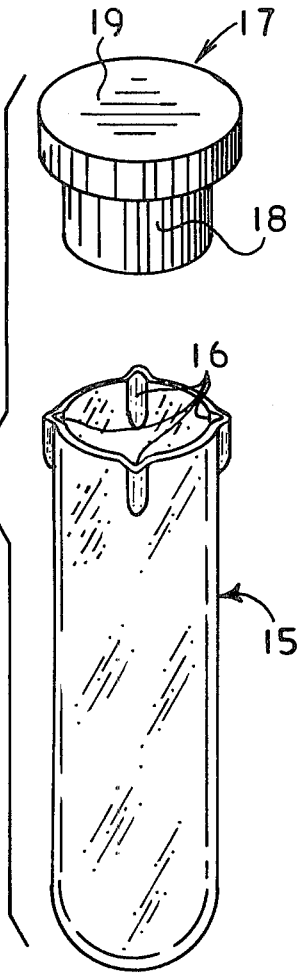
PRIOR ART FIG. 4
FIG. 4 is an isometric view of the vacuum tube of the present invention showing one embodiment of the vents in the mouth of the tube with a solid (non-vented) stopper preparatory to insertion into the tube.
Figure 5:
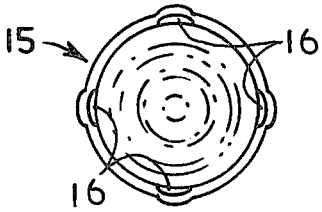
FIG. 5 is an end view of the tube of FIG. 4.

The vacuum tube 15 of the present invention, illustrated in FIGS. 4 and 5, has one or more vents 16 formed around the mouth of the glass tube. The mouth can be flared or cylindrical to assist assembly or maintain tightness, the choice being dictated by manufacturing, process or functional needs. The vent geometry can be any shape that can be formed without creating excessive stress concentration areas, i.e. grooves, channels, indentations, slots or the like. The vent or vents in the tube permit the use of a solid stopper 17 formed of a plug portion 18 and a cap portion or flange 19, and eliminates the need for a vent in the stopper. The length of the vent from the edge of the mouth of the tube must be sufficiently less than the length of the plug portion of the stopper to be inserted into the mouth of the tube to allow stopper to remain assembled with the tube until tube is evacuated and while stopper is being seated.

The number and shape of vents required depends upon the rate of evacuation desired, the forming stress concentration allowable, and the probability of occlusion by an improperly pre-placed stopper. An additional economic factor would be material usage considerations of one pattern of vents, or shape, or length compared to alternative number or sizes. For example, a longer vent would decrease the probability of occlusion but would require more tube and stopper material to maintain the same seal confidence. The aim is to attain stopper pre-placement ability. This can be accomplished by making the vent long enough to prevent occlusion. As for the number of vents, one vent of the right size and length would operate satisfactorily, but more than one vent of a smaller size and length would be preferred because it would be more difficult for the tube to occlude with say three such vents. The shape of the vent can be any configuration that satisfies the venting requirements, sealing requirements and pouring requirements simultaneously or independently. However, the preferred embodiment would minimize stress concentration, by including smooth inside edges for each channel and a semi-circular channel section with a hemispherical or spherical segment transition area.

Figure 6:
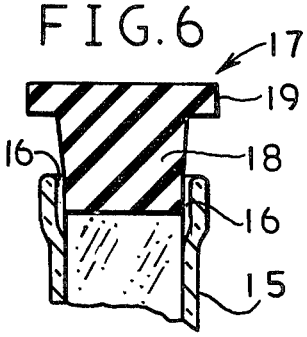
FIG. 6 is a sectional view similar to FIG. 4, partly broken away, showing the solid stopper pre-positioned in the mouth of the tube.
Figure 7:
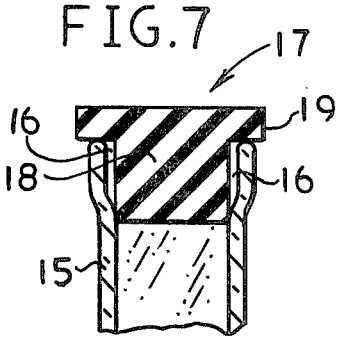
FIG. 7 is a view similar to FIG. 5, showing the solid stopper seated up to its shoulder in the tube.

The vented vacuum tube of the present invention is used in the same way as described above for the vacuum tube presently in use where the stopper is vented rather than the vacuum tube. The solid stopper 17 is pre-positioned in the glass tube 15 (FIG. 6) allowing only a required length of vent exposed to the atmosphere between the stopper and tube to permit removal of air in the tube. Upon removal of air, the stopper is driven into the tube so that the cap 19 rests against the edge of the tube and the plug 18 seals the tube from the atmosphere (FIG. 7).

The advantages of the vented tube of the present invention over the tube presently in use are as follows:

(a) It permits the use of a solid stopper which reduces cell entrapment or attachment to the slot in the stopper;

(b) The vent of the tube can be used as a pouring spout;

(c) The vent allows pre-placement of solid stopper prior to evacuation, which siimplifies assembly;

(d) The vents prevent the tube from rolling when the stopper is removed from the tube and, if vents are extended beyond stopper flange, roll will also be prevented when stopper is inserted in the tube.

(e) It minimizes aerosol effect when removing stopper.

Figure 8:
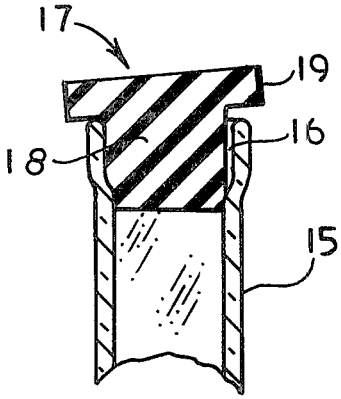
FIG. 8 is a view similar to FIG. 7 showing the solid stopper when there is a lateral load but the seal area remains undisturbed.

(f) The stopper seal is less vulnerable (for same lateral load). (Compare FIG. 3 with FIG. 8).

Those skilled in the art will appreciate that variations of the above described embodiment of the invention may be made without departing from the spirit and scope of the invention.

What is claimed is:

1. A vacuum container assembly, which comprises;

(a) an air-evacuated tubular container having a first closed end and a second open end, adapted to receive in the open end a stopper having a plug portion to fit in the open end and a flange portion to sit on the edge of the open end; said container having at least one vent channel on the inner surface of the tubular container, having an open end at the edge of the container and extending from the edge of the open end to a predetermined point on the inner surface of the container distal from the open end; and (b) a stopper mounted in the open end of the tubular container, said flange portion closing the open end of the vent channel and said plug portion closing the remaining open area of the vent channel; whereby the vent channel is sealed apart from the air-evacuated container.

2. The assembly of claim 1 wherein there are a plurality of vent channels spaced around the inner surface of the container.

3. The assembly of claim 1 wherein the vent channel has smooth inside edges and a semi-circular channel section.

* * * * *